United States Patent [19]

Vesborg

[11] Patent Number: 4,572,384

[45] Date of Patent: Feb. 25, 1986

[54] CONTAINER WITH CATENARY-FORMED CONTOUR

[75] Inventor: Steen Vesborg, Copenhagen, Denmark

[73] Assignee: Colgate-Palmolive Company, New York, N.Y.

[21] Appl. No.: 730,395

[22] Filed: May 3, 1985

Related U.S. Application Data

[63] Continuation of Ser. No. 528,682, Sep. 1, 1983, abandoned.

[30] Foreign Application Priority Data

Sep. 6, 1982 [DK] Denmark ..... 3974/82

[51] Int. Cl.[4] ..... B65D 1/02

[52] U.S. Cl. ..... 215/1 C; D9/378; D9/383

[58] Field of Search ..... 215/1 C, 1 R; D9/378, D9/383

[56] References Cited

U.S. PATENT DOCUMENTS

| | | | |
|---|---|---|---|
| D. 212,456 | 10/1968 | Vanderhyde | D9/378 |
| D. 217,227 | 4/1970 | Christiansen | D9/378 X |
| D. 223,142 | 3/1972 | Koenigsberg | D9/378 X |
| D. 224,733 | 9/1972 | Vanderhyde | D9/378 |
| D. 237,254 | 10/1975 | Kretz | D9/378 |
| D. 246,632 | 12/1977 | Gulley et al. | D9/378 |
| D. 247,424 | 3/1978 | Luedtke | D9/378 X |
| D. 252,556 | 8/1979 | Kretz | D9/378 |
| D. 268,898 | 5/1983 | Douglas | D9/378 |
| D. 268,902 | 5/1983 | Douglas | D9/383 |
| D. 278,681 | 5/1985 | Prahs | D9/378 |

FOREIGN PATENT DOCUMENTS

| | | | |
|---|---|---|---|
| 367104 | 3/1963 | Italy | 215/1 C |
| 2127375 | 4/1984 | United Kingdom | 215/1 C |

*Primary Examiner*—Steven M. Pollard

*Attorney, Agent, or Firm*—Herbert S. Sylvester; Murray M. Grill; John A. Stemwedel

[57] ABSTRACT

A container especially suited for detergents and resistant to downward pressures due to stacking during storage and transportation. The contours of the container are constructed with segments of an inverted catenary, especially at the shoulders of the container. A handle is located in such a manner that the contour of the catenary segment is unbroken as far as possible.

6 Claims, 5 Drawing Figures

CONTAINER WITH CATENARY-FORMED CONTOUR

This is a continuation of application Ser. No. 06/528,682 filed Sept. 1, 1983, now abandoned.

FIELD OF INVENTION

This invention relates to containers, especially bottles and jugs for detergent products, and more particularly to container structures which resist the stresses of shipment and storage.

BACKGROUND OF THE INVENTION

Bottles and jugs are commonly used to package a wide variety of liquid, paste and powder cleaning materials. These containers are usually shipped in cartons that contain many individual product containing bottles or jugs in one or two layers or tiers. When such cartons are piled or stacked for shipment or storage, the individual containers, especially on the lower or bottom layers are subject to great pressure from above. Containers often bend at the neck under those pressures and the sidewalls of the containers are ruptured. One solution for this problem has been to increase the thickness of the container sidewall at a loss of container flexibility which makes the container more fragile if dropped by the ultimate user. However to reduce expenses for transportation and packaging materials, it is desirable to make the container walls as thin as possible.

SUMMARY OF THE INVENTION

It is an object of the present invention to provide a novel container which is especially resistant to downward pressures due to stacking of containers and which can be produced less expensively than known containers. It is an additional object to overcome the foregoing mentioned problems and disadvantages of the prior art.

In accordance with the invention, a container is produced which is characterized by the fact that a vertical section through the container on its plane of symmetry substantially describes one or more segments of an inverted catenary or similar curve. A catenary being a curve which can be described in a Cartesian coordinate system by the formula $y=a/2(e^{x/a}+e^{-x/a})$ or $y=a\cdot\cosh(x/a)$. An approximation to a catenary such as a parabola having the formula $y=x^2$ may be used.

The catenary is the curve which describes the shape which a segmented chain will assume when it is suspended at its two ends. The curve describes the ideal course and distribution of the forces between the chain segments. It has been discovered that considerable strengthening of a container over known containers can be achieved by constructing the container so that at least the top and/or bottom sections of its vertical sidewalls are in the shape of segments of an inverted catenary. The strengthened containers are resistant to rupture, especially in the shoulder area near the neck opening passageway.

Further objects of this invention will appear as the description proceeds in connection with the below-described drawings and the appended claims.

DETAILED DESCRIPTION

Figure 1:
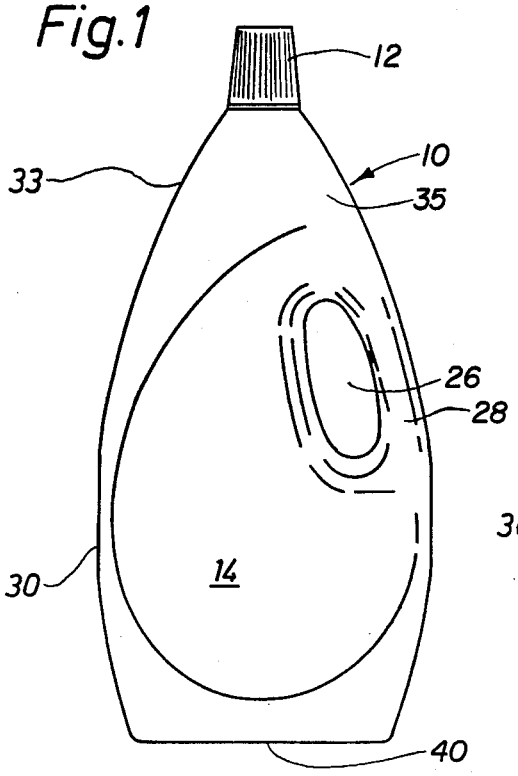
FIG. 1 is an elevational view showing the right side of the container in accordance with the invention.

Referring to the drawings and particularly to FIGS. 1–4, the container of this invention is indicated at 10. As shown in FIG. 1, a closure cap 12 is provided to seal the container. The closure cap is retained in place on neck 22 by an outer thread 24 which corresponds to an inner thread (not shown) on the closure cap 12. When the neck 22 has an inward conical taper as is shown, the cooperating threads will trace spiral paths. If the neck is cylindrical, the threads will be helical. The upper contours 33 and 35 take the shape of segments of an inverted catenary.

The horizontal cross section of the container has an essentially elliptical cross section of high order, i.e. an ellipse approaching a rectangle, so that the container has two broad principal sides or faces 14 and 16 and a narrow front 18 and a narrow back 20.

Side 14 of the container has the characteristic partial catenary section of the invention which results from taking a vertical section through the container wall and the central axis of the container. This catenary section 34 extends through the shoulder and neck of the container immediately below the container closure. The major portion of the side is constructed so that the section of the side approaches a straight line rather than a catenary, thereby a curved side is produced which approaches a plane to enable labelling of such surface. The side 16 is also somewhat planar to permit embossing while retaining its catenary configuration at segment 32 in the upper portion.

In a preferred embodiment of the invention, the container is provided with a handle 28. The handle is formed in such a way that the sides 14 and 16 bend and converge to form an oblong opening 26 adjacent the back 20 of the container and in such a way that the longitudinal direction of the opening is substantially parallel to the portion of the back which is at the same level as the opening. The opening 26 for the handle is preferably located almost in the middle of the container or just above the middle as shown in FIGS. 1–4. The handle itself thus consists of a part of the back 20 of the container and parts of the two converging sides 14 and 16.

It is preferable that the opening 26 for the handle 28 be constructed as a narrow oblong opening with a longitudinal axis substantially parallel to the back of the part in question. Thereby the catenaries are only interrupted in a relatively narrow area.

Figure 3:
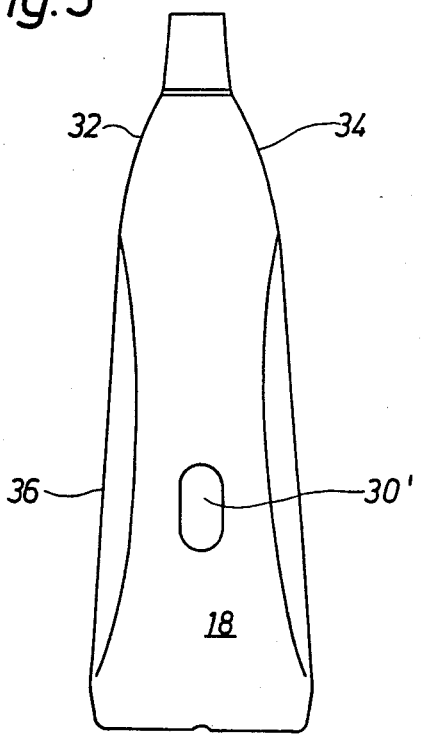
FIG. 3 is a front elevational view of the container of FIG. 1.
Figure 4:
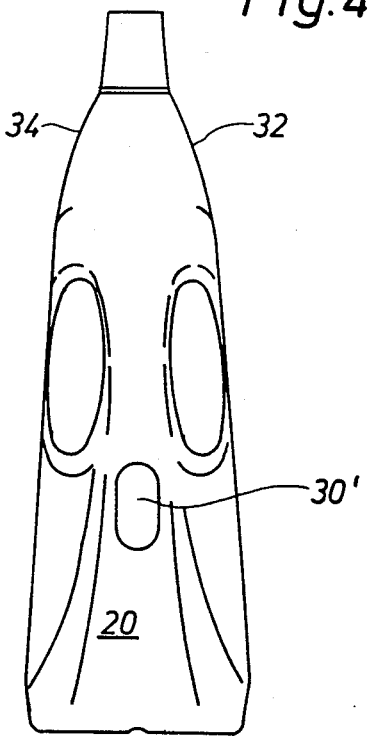
FIG. 4 is a rear elevational view of the container of FIG. 1.

From FIGS. 3 and 4, it is seen that the contour of the container corresponds to an inverted catenary in two parts at the shoulders 32, 34 of the container, whereas the surfaces lower down on the container are replaced by straight line segments 36, 38. As the ideal catenary in the narrow version, which is present when the container is viewed from the front or from the back, is almost rectilinear in the parts in question, this approximation is reasonable, and the container is not thereby weakened considerably. Simultaneously this construction provides a side suitable for labelling. Viewed from the relatively narrow back and front, the contour of the container substantially follows an inverted catenary from top to bottom.

Figure 2:
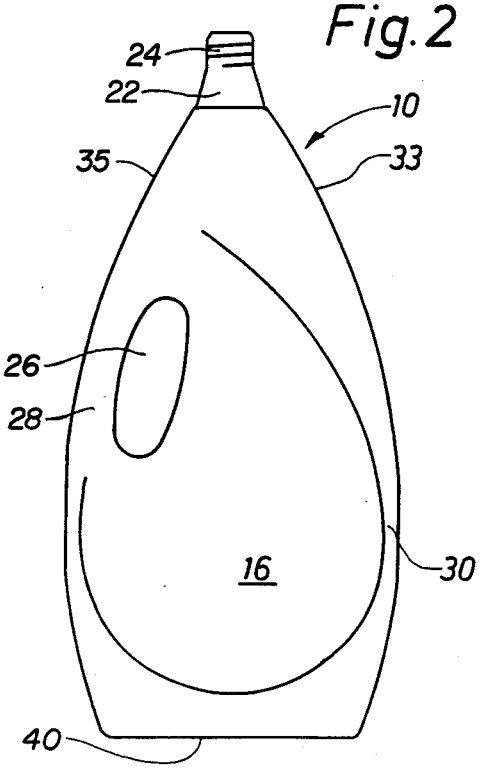
FIG. 2 is an elevational view showing the left side of the container of FIG. 1 with the closure cap removed.
Figure 5:
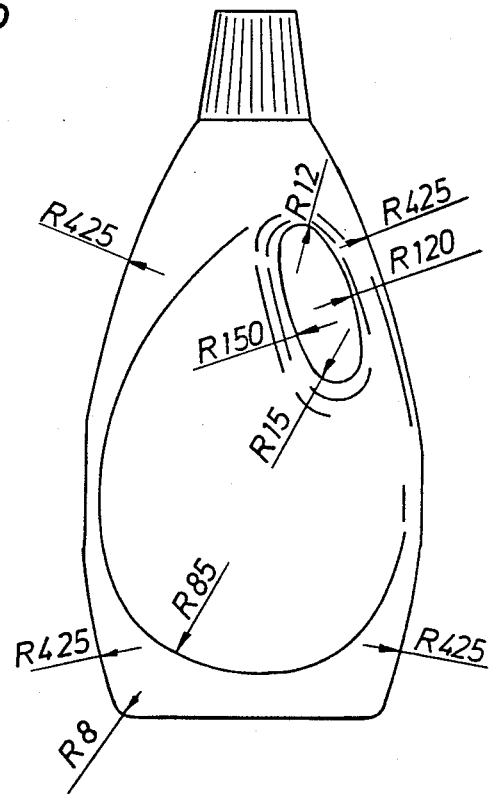
FIG. 5 is an elevational view showing the right side of another embodiment of the invention.

From FIGS. 1 and 2 it is seen that the contour of the container viewed from the side also corresponds to an inverted catenary in two parts at the shoulders 33, 35 of the container. The contour of the bottom part of the container adjacent to a relatively broad bottom portion 40 is, however, symmetrical to a part of the contour of the top half and thus corresponds per se to a part of a non-inverted catenary. The two curves are interconnected by a rectilinear portion 30 forming an almost even connection between the curves. The rectilinear portions form part of abutting surfaces 30', by which the containers lean against each other when a number of containers are placed front or back against front or back. The abutting surfaces 30' are shown in FIGS. 3 and 4. Similarly parts of the catenary can be replaced by other curves which approached piecemeal may correspond to part of a catenary segment. A parabola can be mentioned as an example of such a curve. Circular arcs may also be used as approximation as shown on FIG. 5 of the construction drawing which shows how the container in practice can be produced by means of circular arcs forming suitable contours. The radii of the arcs are in millimeters.

The container may be manufactured by blow-moulding and is especially suited for stretch-blow-moulding.

The container can be produced of glass or plastic e.g. plastic of the following types: polyethylene, polypropylene, polyethyleneterephthalate, polyethyleneterephthalate glycol, polyvinyl chloride, acrylonitrile and copolymers thereof. The said materials may be supplemented with calcium carbonate and talc or reinforced with glass fibres asbestos or carbon fibres.

The invention can be varied in different ways with respect to the embodiment shown, the opening for the handle can e.g. be placed in a different way. The handle can possibly also be constructed without a throughgoing opening, so that the sides are only pressed more or less towards each other to form a recess in at least one side. According to the invention it is essential that a great part of the contour of the container follows an inverted catenary. The handle should consequently be placed so that these contour curves are unbroken to the greatest possible extent.

The invention may be embodied in other specific embodiments without departing from the spirit or essential characteristics thereof. The present embodiments are therefore to be considered illustrative and not restrictive, the scope of the invention being indicated by the appended claims rather than by the foregoing description, and all changes which come within the meaning and range of equivalency of the claims are therefore intended to be embraced therein.

I claim:

1. A container in the form of a bottle or jug for detergent products which is resistant to downward pressures having a body the horizontal section of which describes an ellipse of high order and which narrows towards the top, and at least one part of a vertical section of which through the upright container in a plane through the central axis of the container describes segments of an upper inverted catenary and of a lower catenary interconnected by a rectilinear portion.

2. The container in accordance with claim 1 wherein each vertical section through the container in a plane containing the vertical central axis of the container describes at least two segments of an inverted catenary.

3. The container in accordance with claim 1 wherein the major portions of the principal faces are constructed with planar contours.

4. The container in accordance with claim 1 wherein a handle is formed through the bottle which does not break the catenary contour of the container when viewed from a principal side.

5. The container in accordance with claim 1 wherein the contour of the container follows two symmetrical parts of an inverted catenary from top to bottom when the container is viewed from the narrow side of the container.

6. The container in accordance with claim 1 wherein an upper part of the contour, viewed from a principal face of the container, substantially follows a segment of an inverted catenary, a lower part of the contour substantially follows a segment of an inverted catenary symmetric to the segment of the upper part, and the catenary segments are connected by straight line segments which form planes which abut the front and back of the container.

* * * * *